US007728523B2

(12) United States Patent
Nishimura

(10) Patent No.: US 7,728,523 B2
(45) Date of Patent: Jun. 1, 2010

(54) PLASMA DISPLAY PANEL WITH STABILIZED ADDRESS DISCHARGE AND LOW DISCHARGE START VOLTAGE

(75) Inventor: Masaki Nishimura, Osaka (JP)

(73) Assignee: Panasonic Corporation, Osaka (JP)

( * ) Notice: Subject to any disclaimer, the term of this patent is extended or adjusted under 35 U.S.C. 154(b) by 760 days.

(21) Appl. No.: 11/628,116

(22) PCT Filed: May 17, 2006

(86) PCT No.: PCT/JP2006/309807

§ 371 (c)(1),
(2), (4) Date: Dec. 1, 2006

(87) PCT Pub. No.: WO2006/123683

PCT Pub. Date: Nov. 23, 2006

(65) Prior Publication Data

US 2009/0160333 A1 Jun. 25, 2009

(30) Foreign Application Priority Data

May 17, 2005 (JP) ..... 2005-143780

(51) Int. Cl.
*H01J 17/49* (2006.01)

(52) U.S. Cl. ..... 313/586

(58) Field of Classification Search ..... 313/582–587; 315/169.4; 345/60, 30, 37, 41, 71; 445/24
See application file for complete search history.

(56) References Cited

U.S. PATENT DOCUMENTS 6,097,150 A * 8/2000 Watanabe ..... 313/582
6,242,864 B1 6/2001 Nakahara et al.
6,713,958 B2 * 3/2004 Oniki ..... 313/582
6,788,373 B2 9/2004 Ito et al.
6,879,107 B2 4/2005 Hirano et al.
6,995,104 B2 2/2006 Park et al.
7,166,961 B2 1/2007 Park (Continued)

FOREIGN PATENT DOCUMENTS

CN 1518036 8/2004

(Continued)

OTHER PUBLICATIONS

Hiraki Uchiike et al., "All About Plasma Display", May 1, 1997, pp. 79-80.

(Continued)

*Primary Examiner*—Peter Macchiarolo
(74) *Attorney, Agent, or Firm*—Wenderoth, Lind & Ponack, L.L.C.

(57) ABSTRACT

A plasma display panel in which a front panel (1) including at least display electrodes (6) and a dielectric layer (7), and a rear panel (2) are faced to each other, to form a discharge space (14) therebetween, and a discharge gas is filled into the discharge space (14). A protective layer (8) made of magnesium oxide containing at least one element of silicon and aluminum added thereto is provided over the dielectric layer (7). The discharge gas contains at least xenon and hydrogen. The concentration of one of the silicon and the aluminum in the protective layer (8) ranges from 30 to 50,000 ppm inclusive. The concentration of the hydrogen is up to 10,000 ppm.

17 Claims, 4 Drawing Sheets

U.S. PATENT DOCUMENTS

| | | | | |
|---|---|---|---|---|
| 7,208,875 | B2 | 4/2007 | Kwon et al. | |
| 7,208,876 | B2 | 4/2007 | Kang et al. | |
| 7,218,050 | B2 * | 5/2007 | Hasegawa et al. | 313/587 |
| 7,315,122 | B2 | 1/2008 | Kwon et al. | |
| 7,323,818 | B2 | 1/2008 | Kwon et al. | |
| 7,327,083 | B2 | 2/2008 | Woo et al. | |
| 7,425,797 | B2 | 9/2008 | Woo et al. | |
| 7,432,656 | B2 * | 10/2008 | Morita et al. | 313/587 |
| 7,462,985 | B2 * | 12/2008 | Nishimura | 313/582 |
| 7,605,537 | B2 | 10/2009 | Kim et al. | |
| 2001/0015621 | A1 * | 8/2001 | Oniki | 313/582 |
| 2004/0070341 | A1 | 4/2004 | Park | |
| 2004/0124775 | A1 * | 7/2004 | Okada et al. | 313/587 |
| 2004/0131884 | A1 | 7/2004 | Park et al. | |
| 2004/0145316 | A1 | 7/2004 | Nishitani et al. | |
| 2005/0001551 | A1 | 1/2005 | Kim et al. | |
| 2005/0236989 | A1 * | 10/2005 | Okada | 313/582 |
| 2006/0012721 | A1 | 1/2006 | Morita et al. | |
| 2006/0273719 | A1 * | 12/2006 | Nishimura | 313/567 |
| 2009/0167177 | A1 * | 7/2009 | Lee et al. | 313/582 |

FOREIGN PATENT DOCUMENTS

| | | | |
|---|---|---|---|
| JP | 9-92161 | | 4/1997 |
| JP | 10-334809 | | 12/1998 |
| JP | 11-120920 | | 4/1999 |
| JP | 2000-267625 | | 9/2000 |
| JP | 2002-33053 | | 1/2002 |
| JP | 2003-031136 | | 1/2003 |
| JP | PCT/JP03/14349 | * | 4/2003 |
| JP | 2003-132801 | | 5/2003 |
| JP | 2004-103273 | | 4/2004 |
| JP | 2004-205655 | | 7/2004 |
| JP | 2004-363079 | | 12/2004 |
| JP | 2005-310581 | | 11/2005 |
| KR | 10-2004-0032668 | | 4/2004 |
| KR | 10-2004-0037270 | | 5/2004 |
| WO | 2004/049375 | | 6/2004 |
| WO | 2005/098890 | | 10/2005 |

OTHER PUBLICATIONS

Akitoshi Taniguchi "Part by Part Characteristics and Recent Case Example with PDP Development", Mar. 26, 2004, pp. 216-218.

Tsutae Shinoda et al., "35.4: New Approach for Wall Display with Fine Plasma Tube Array Technology", SID 02 Digest, pp. 1072-1075.

* cited by examiner

PLASMA DISPLAY PANEL WITH STABILIZED ADDRESS DISCHARGE AND LOW DISCHARGE START VOLTAGE

THIS APPLICATION IS A U.S. NATIONAL PHASE APPLICATION OF PCT INTERNATIONAL APPLICATION PCT/JP2006/309807.

TECHNICAL FIELD

The present invention relates to a plasma display panel used for a display device and the like.

BACKGROUND ART

A plasma display panel (hereinafter referred to as a PDP) is basically made of a front panel and a rear panel. The front panel includes: glass substrate; stripe-like display electrodes, each formed of a transparent electrode and bus electrode on one principle surface of the glass substrate; a dielectric glass layer over the display electrodes working as a capacitor; and a protective layer made of magnesium oxide (MgO) formed over the dielectric layer.

The glass substrate is manufactured by the float method, which is used to make a large and flat area. In the display electrodes, a paste containing silver (Ag) to ensure electrical conductivity is applied to the transparent electrodes made by a thin-film forming process, in a predetermined pattern. Then, the pattern is fired to form bus electrodes. A dielectric layer is formed by applying and firing a dielectric paste to cover the display electrodes made of transparent electrodes and bus electrodes. Lastly, a protective layer made of MgO is formed over the dielectric layer using the thin-film forming process.

On the other hand, the rear panel includes: a glass substrate; stripe-like address electrodes formed on one principle surface of the glass substrate; a dielectric layer covering the address electrodes; barrier ribs formed on the dielectric layer; and phosphor layers formed on the dielectric layer between the respective barrier ribs to emit light of red, green, or blue.

The front panel and the rear panel are hermetically sealed with their electrode-forming sides facing to each other. A discharge gas, such as neon(Ne)-xenon(Xe), is filled into a discharge space partitioned by the barrier ribs at a pressure ranging from 400 to 600 Torr. In the PDP, selectively applying an image signal voltage to the display electrodes generates a gas discharge, and ultra-violet rays generated by the discharge excite the respective phosphor layers to emit light of red, green, and blue. "All about plasma display panels" (co-authored by Heiki Uchiike and Shigeo Mikoshiba, published by Kogyo Chosakai Publishing Inc. on May 1, 1997, p. 79-80) discloses an example of displaying color images in such a manner.

A method of dividing one frame of image into a plurality of sub fields (SF) for gradation representation is used to display images. In this method, one SF is divided into an initializing period, addressing period, sustaining period, and erasing period, to control discharge. As a technique of performing stable address discharge during the addressing period for selecting pixels to be lit, Japanese Patent Unexamined Publication Nos. H10-334809, 2003-132801, and 2004-103273 disclose a technique of adding silicon (Si) or aluminum (Al) element to MgO of each protective layer in a concentration ranging from several hundred parts per million to several percents, to improve the electron emission characteristics of the protective layer.

Further, Japanese Patent Unexamined Publication No. 2000-267625 and "The component-specific characteristics and the latest developments of PDPs" (published by JOHOKIKO Co., Ltd. on Mar. 26, 2004, p. 216-218) disclose a technique of changing the discharge waveform during the initializing period into a generally rectangular pulse to have a gradual slope and inhibiting variations in address discharge voltage caused by variations in the shape of each discharge cell or difference in the charged state of the phosphors.

However, recently, there has been growing expectations on image display devices with higher definition, higher gradation, and lower power consumption, such as a high-definition television screen. For full-specification high-definition television screens 24 in. in diagonal that have particularly been expected, the number of pixels is 1920×1125 and the pitch of discharge cells is as small as 0.15 mm×0.48 mm. Such a high-definition PDP poses a problem in that decreases in brightness and efficiency become particularly apparent.

Measures taken to address this problem are to increase the brightness and efficiency by setting the Xe concentration of the discharge gas in the PDP to at least 5%, which is higher than the conventional concentration, or using barrier ribs arranged in a double cross. However, when the Xe concentration of the discharge gas in the PDP is set to at least 5% or barrier ribs arranged in a double cross is used to increase brightness, considerable increases in driving voltage and more unstable address discharge cannot provide high-quality images. When the Xe concentration increases, increases in the amount of Xe ions and MgO more likely to be sputtered shorten the life of the protective layer.

Generally, a method of adding the Si or Al element to MgO to increase electron emission from MgO is employed to address the problem of unstable discharge caused by increases in driving voltage. However, even though this method can make driving voltage slightly smaller in than the case of using a protective layer made of MgO only, the method cannot stabilize address discharge for a high-definition PDP having a relatively long addressing period.

Particularly for a high-definition PDP having an increased Xe concentration of at least 5%, addition of Si or Al to MgO to speed up address scan, stabilize address discharge, and decrease the voltage causes the following problems. When the PDP is attempted to be lit by a method using wall charge on the dielectric layer during the initializing discharge, the driving voltage is lower than that of a PDP using the conventional MgO protective layer. However, excellent characteristics of electron emission from the MgO protective layer even erase the wall charge formed during the initializing period, thus causing lighting failures (addressing failures) and deterioration of image quality.

When a gradually-sloping voltage waveform is used to stabilize address discharge and decrease address voltage, lighting failures (addressing failures) occur more prominently.

SUMMARY OF THE INVENTION

In a PDP of the present invention, a front panel and a rear panel, each including at least electrodes and a dielectric layer, are faced to each other to form a discharge space, and a discharge gas is filled in the discharge space. The dielectric layer has thereon a protective layer that is made of MgO containing at least one element of Si and Al added thereto. The discharge gas contains at least Xe and hydrogen ($H_2$).

Such a structure can provide a PDP that causes no lighting failures (addressing failures) during address discharge, has high brightness and low operating voltage, and ensures stable driving for an extended period.

REFERENCE MARKS IN THE DRAWINGS

| | |
|---|---|
| 1 | Front panel |
| 2 | Rear panel |
| 3 | Front glass substrate |
| 4 | Scan electrode |
| 4a, 5a | Transparent electrode |
| 4b, 5b | Bus electrode |
| 5 | Sustain electrode |
| 6 | Display electrode |
| 7, 11 | Dielectric layer |
| 8 | Protective layer |
| 9 | Rear glass substrate |
| 10 | Address electrode |
| 12 | Barrier rib |
| 13 | Phosphor layer |
| 13R | (Red) phosphor layer |
| 13G | (Green) phosphor layer |
| 13B | (Blue) phosphor layer |
| 14 | Discharge space |

DETAILED DESCRIPTION OF THE INVENTION

Hereinafter, a description is provided of a PDP in accordance with the exemplary embodiment of the present invention.

Figure 1:
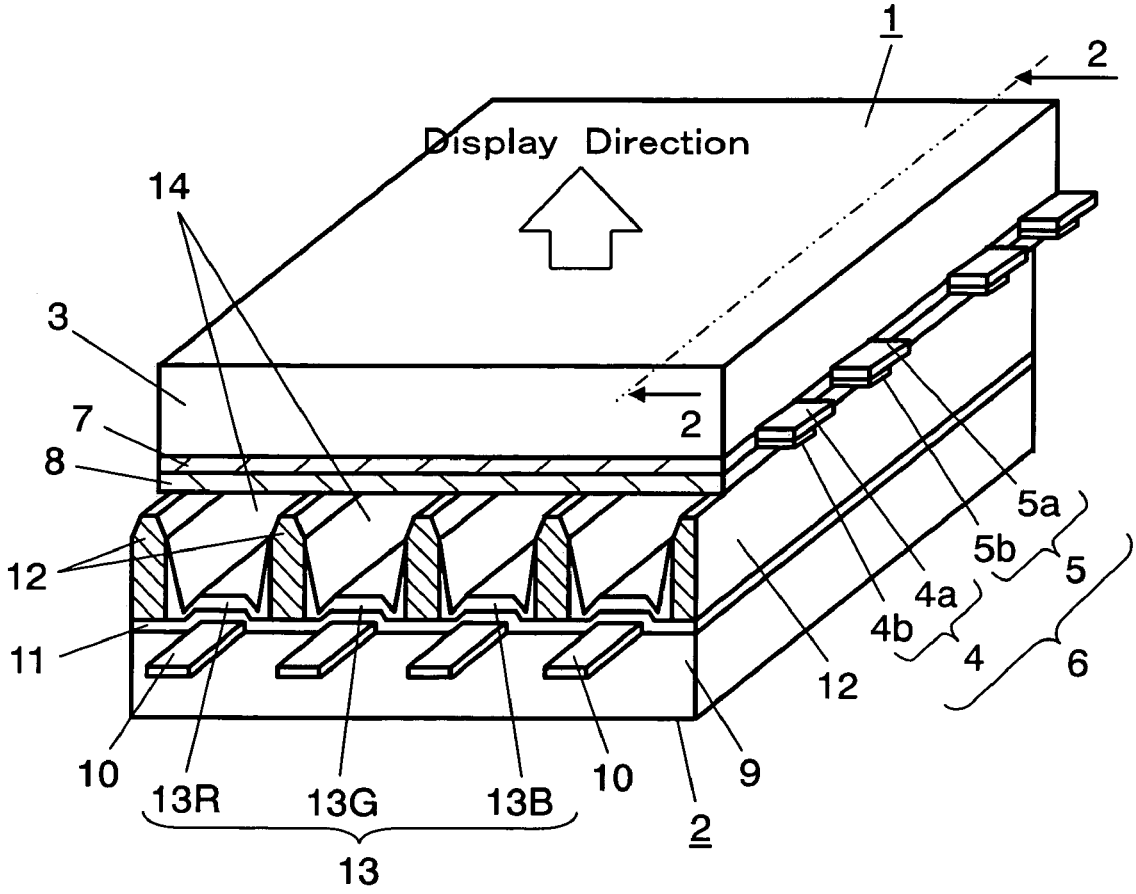
FIG. 1 is a section view in perspective illustrating a principal structure of a plasma display panel (PDP) in accordance with an exemplary embodiment of the present invention.
Figure 2:
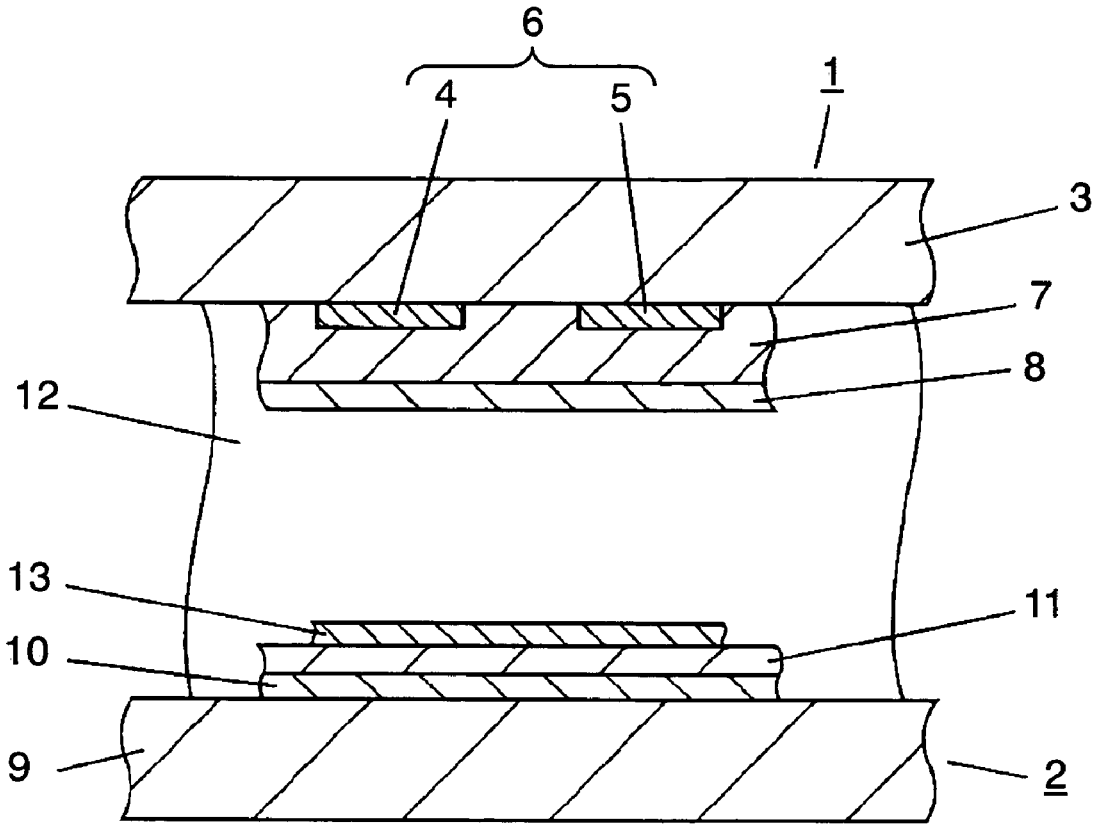
FIG. 2 is a section view taken on line 2-2 of FIG. 1.

FIG. 1 is a section view in perspective illustrating a principal structure of a PDP in accordance with the exemplary embodiment of the present invention. FIG. 2 is a section view taken on line 2-2 of FIG. 1. As shown in FIG. 1, the PDP is made of front panel 1 and rear panel 2 facing to each other so that a discharge space is formed therebetween.

First, front panel 1 is described. Stripe-like scan electrode 4 and sustain electrode 5 are disposed on front glass substrate 3 on the side of rear panel 2 so as to sandwich a surface-discharging gap therebetween and form display electrode 6. In other words, display electrodes 6 are formed of parallel pairs of scan electrode 4 and sustain electrode 5. Scan electrode 4 and sustain electrode 5 are made of transparent electrodes 4*a* and 5*a* that are formed of a transparent electrically-conductive material, such as indium oxide (ITO) and tin oxide ($SnO_2$), and bus electrodes 4*b* and 5*b* that have a smaller width and higher electrical conductivity than transparent electrodes 4*a* and 5*a* formed thereon, respectively. Each of bus electrodes 4*b* and 5*b* is made of one of Ag thin film (thickness: 2 to 10 μm), Al thin film (thickness: 0.1 to 1 μm), and chromium/copper/chromium (Cr/Cu/Cr) laminated thin film (thickness: 0.1 to 1 μm).

Dielectric layer 7 made of a dielectric glass material having PbO—$SiO_2$—$B_2O_3$—ZnO—BaO-based glass composition, for example, is formed over front glass substrate 3 having display electrodes 6 formed thereon, so that the dielectric layer covers display electrodes 6. Protective layer 8 is further laminated over all the areas of dielectric layer 7. Protective layer 8 is made of a thin film essentially consisting of MgO. For example, protective layer 8 essentially consists of MgO containing 30 to 50,000 ppm of at least one of Si and Al.

Next, rear panel 2*a* is described. Address electrodes 10 shaped like stripes are formed on rear glass substrate 9 on the side of front panel 1. Dielectric layer 11 is further formed to cover address electrodes 10. On dielectric layer 11, stripe-like barrier ribs 12, for example, are disposed between address electrodes 10. In the stripe-like recesses formed of barrier ribs 12 and dielectric layer 11, red phosphor layer 13R made of positively-charged (Y, Gd)$BO_3$:Eu or $Y_2O_3$:Eu, green phosphor layer 13G made of negatively-charged $Zn_2SiO_4$:Mn or positively-charged (Y, Gd)$BO_3$:Tb, and blue phosphor layer 13B made of positively-charged $BaMgAl_{10}O_{17}$:Eu are disposed in an orderly manner at a cell pitch of 0.16 mm (for a high-definition television 42 in. in diagonal).

Front panel 1 and rear panel 2 structured as above are faced to each other, as shown in FIG. 1, so that address electrodes 10 and display electrodes 6 are orthogonal to each other. Thus, discharge space 14 is formed to be surrounded by the stripe-like recesses made of barrier ribs 12 and phosphor layers 13R, 13G, and 13B of respective colors, and protective layer 8. The outer peripheries of front panel 1 and rear panel 2 are glass-sealed, and a discharge gas is filled into discharge space 14 to complete a PDP. Therefore, the areas where display electrodes 6 intersect address electrodes 10 form discharge cells working for image display. In discharge space 14, a discharge gas is filled at a pressure ranging from approx. 400 to 600 Torr inclusive.

In the PDP, discharge occurring in the respective discharge cells generates ultra-violet rays having a shortwave (wavelength: approx. 147 nm). These ultra-violet rays excite phosphor layers 13R, 13G, and 13B of respective colors to emit light for image display.

In the exemplary embodiment of the present invention, gases to be filled into discharge space 14 include at least one of helium (He), neon (Ne), and argon (Ar), in addition to xenon (Xe) and $H_2$, and have a Xe concentration of at least 5%. On the other hand, the $H_2$ concentration ranges 30 to 10,000 ppm inclusive, and more preferably, ranges from 50 to 1,000 ppm inclusive.

Increasing the Xe concentration in discharge gas can increase brightness but also raises discharge voltage. Thus, the circuit components and PDP structure require measures against high withstand voltage, which increases power consumption and component cost.

However, in the PDP of this exemplary embodiment, a discharge gas having an increased Xe concentration of at least 5% and containing 30 to 10,000 ppm of $H_2$ added thereto is combined with protective layer 8 of MgO containing Si or Al added thereto. This combination can increase brightness, stabilize address discharge, and inhibit increases in discharge voltage. In this exemplary embodiment of the present invention, the reasons for stabilizing address discharge and inhibiting increases in discharge voltage are considered as follows.

When Si or Al is simply added to the MgO protective layer like a conventional art, sputtering the surface of the protective layer during discharge causes Si or Al in the protective layer to separate from the protective layer, and causes only MgO to adhere to the surface again. Thus, the concentration of Si or Al on the surface of the protective layer decreases accordingly. For this reason, addition of Si or Al does not exert long electron emission effects.

However, it is considered that existence of an appropriate amount of $H_2$ in the discharge gas like this exemplary embodiment inhibits Si or Al in protective layer 8 from being sputtered, and the amount of Si or Al is always constant and stable in MgO. This is because hydrogen atom H is smaller than those of Mg, Al, Si, and O in atomic radius and weight, and thus can move relatively quickly in the discharge space or MgO crystal grating. Thus, it is considered that $H_2$ captured into the MgO crystals work as a buffer to inhibit separation of Si or Al from MgO. It is further considered that addition of $H_2$ inhibits disappearance of wall charge.

When the Xe concentration in the discharge gas is 5% or higher, increases in the Xe ion concentration during discharge raises the sputtering yield, thus more intensely separating Si or Al from MgO. For this reason, adding $H_2$, as an ingredient, to the discharge gas having a high Xe concentration is extremely effective to keep discharge stability and inhibit disappearance of the wall charge.

In this exemplary embodiment of the present invention, PDPs having different amounts of Si or Al added to MgO, and different Xe and $H_2$ concentrations are produced, and their performances are evaluated. Table 1 shows the results.

TABLE 1

| | Protective layer | | | Lighting evaluation | |
|---|---|---|---|---|---|
| | Amount of Si or Al added | Discharge gas essentially consisting of Ne | | Stability of | Voltage Vs necessary |
| PDP Number | to MgO (ppm) | Xe concentration (%) | $H_2$ concentration (ppm) | address discharge | to keep wall charge(V) |
| 1* | No additive | 5 | Smaller than 5 (Up to detection limit) | ΔUnstable | 80 |
| 2* | Si: 30 | 5 | Smaller than 5 (Up to detection limit) | ○Stable | 125 |
| 3 | Si: 30 | 5 | 50 | ○Stable | 60 |
| 4 | Si: 3000 | 15 | 1000 | ○Stable | 58 |
| 5* | Si: 30000 | 15 | Smaller than 5 (Up to detection limit) | ◎Extremely stable | 175 |
| 6 | Si: 30000 | 15 | 500 | ◎Extremely stable | 62 |
| 7 | Al: 30 | 25 | 1000 | ○Stable | 75 |
| 8 | Al: 3000 | 5 | 500 | ○Stable | 70 |
| 9 | Al: 30000 | 30 | 30 | ◎Extremely stable | 80 |
| 10 | Al: 50000 | 50 | 10000 | ○Stable | 78 |
| 11 | Si: 3000 Al: 3000 | 50 | 500 | ◎Extremely stable | 75 |
| 12 | Si: 30 Al: 100 | 15 | 1000 | ○Stable | 62 |
| 13 | Si: 3000 Al: 30 | 15 | 1000 | ◎Extremely stable | 60 |
| 14* | Al: 3000 | 15 | Smaller than 5 (Up to detection limit) | ○Stable | 115 |
| 15* | No additive | 15 | 500 | ΔUnstable | 90 |

Figure 3:
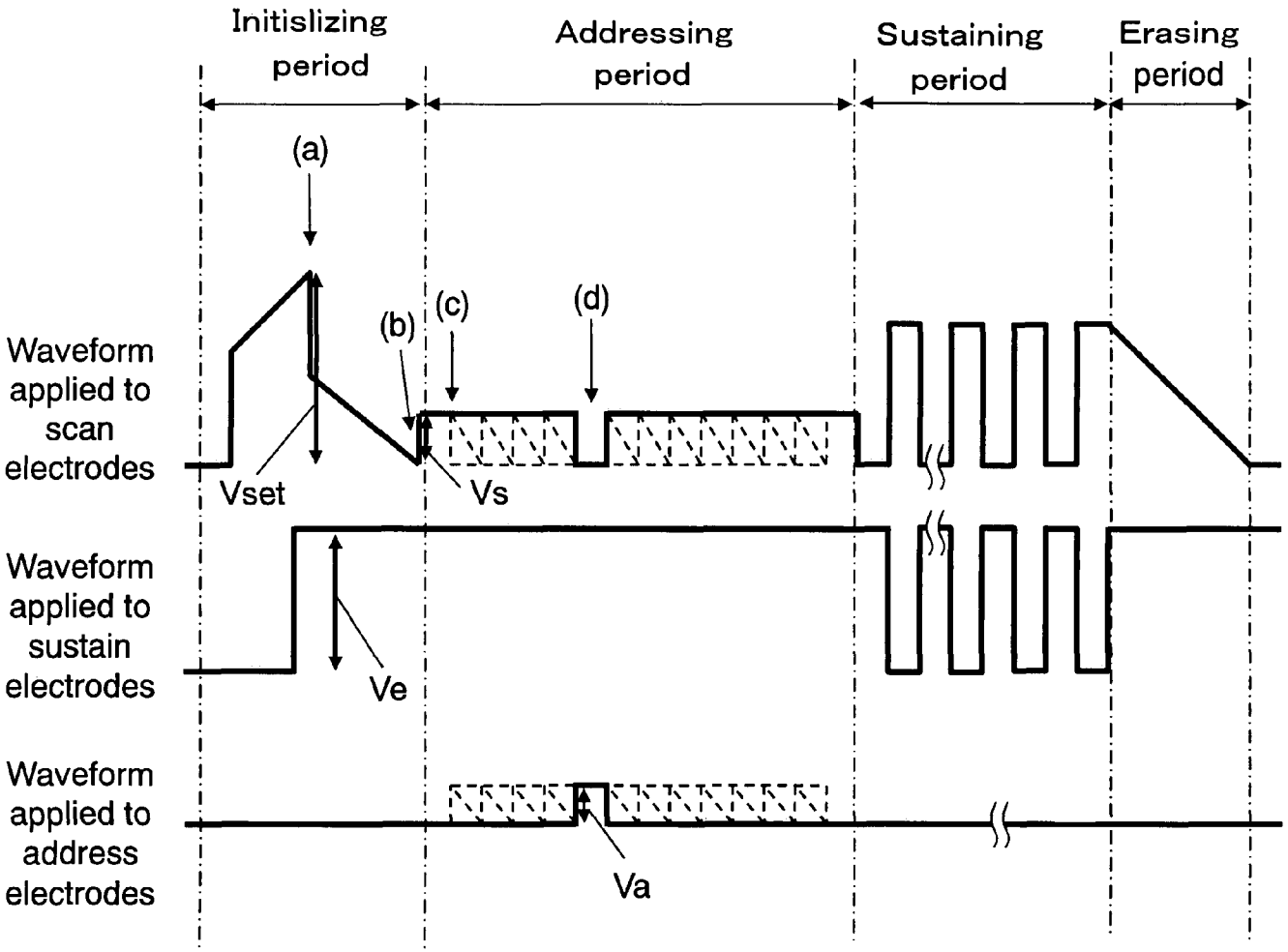
FIG. 3 is a diagram showing driving waveforms of the PDP in accordance with the exemplary embodiment of the present invention.

Table 1 shows conditions of the protective layer and discharge gas and the results of lighting evaluation of the respective PDPs produced. PDP Nos. 1, 2, 5, 14, and 15 are comparative examples for comparison with the exemplary embodiment of the present invention. PDP Nos. 3, 4, 6 through 13 are those in accordance with this exemplary embodiment. With reference to Table 1, for each of the PDPs of this exemplary embodiment, the concentration of Si or Al in MgO ranges from 30 to 50,000 ppm. In the discharge gas, the $H_2$ concentration ranges from 30 to 10,000 ppm, the Xe concentration ranges from 5 to 50%, and the rest of the discharge gas is Ne. Each of these PDPs is lit by driving waveforms using a gradually-sloping initializing waveform as shown in FIG. 3. The discharge stability during address discharge (addressing failure) is checked, and the scan pulse voltage, i.e. a voltage to keep wall charge stable (Vs in FIG. 3), is evaluated. A $H_2$ concentration smaller than 5 ppm, i.e. up to the detection limit, shown in each of PDP Nos. 1, 2, 5, and 14 means that $H_2$ is not positively added to the discharge gas.

When an addressing failure occurs, pixels to originally be lit do not discharge. This deteriorates image quality. The evaluation marks in Table 1 are as follows: a double circle indicates extremely stable address discharge and no flickers in the display screen; a single circle indicates stable address discharge and no such serious flickers as to trouble viewing in the display screen; and a triangle indicates slightly unstable address discharge and some discharge failures. Preferably, voltage Vs necessary to keep wall charge during addressing is small. Generally, when voltage Vs is 150V or higher, a smaller number of general-purpose ICs withstanding the voltage are available. Even when an IC having a withstand voltage of at least 150V is used, a high driving voltage thereof increases the calorific value of the IC, and is likely to cause discharge failures. For this reason, preferably, voltage Vs is smaller, and more preferably, is up to 80V.

Table 1 shows that, for each of PDP Nos. 2, 3, 4, 5, and 6 through 14 containing Si or Al added to MgO, addition of Si or Al in a concentration of at least 30 ppm can obviously reduce addressing failures. On the other hand, for each of PDP Nos. 2, 5, and 14 of Table 1 having a $H_2$ concentration up to the detection limit and Si or Al simply added to MgO, voltage Vs is high. Further, the results of PDP Nos. 2, 5, and 14 show that, at the higher concentration of Si or Al, the address discharge is more stable but voltage Vs tends to be much higher. For each of PDP Nos. 1 and 15 containing no Si or Al added thereto, the address discharge is unstable and voltage Vs is slightly higher. As shown in the results of PDP Nos. 11 through 13, both Al and Si can be added to MgO. In each of these cases, a total of respective concentrations ranging from 100 to 50,000 ppm inclusive can produce the similar effects.

These results show that the panels satisfying two points, i.e. stability of address discharge, and voltage Vs necessary to maintain charge up to 80V, are PDP Nos. 3, 4, and 6 through 13, those in accordance with this exemplary embodiment.

Figure 4A:
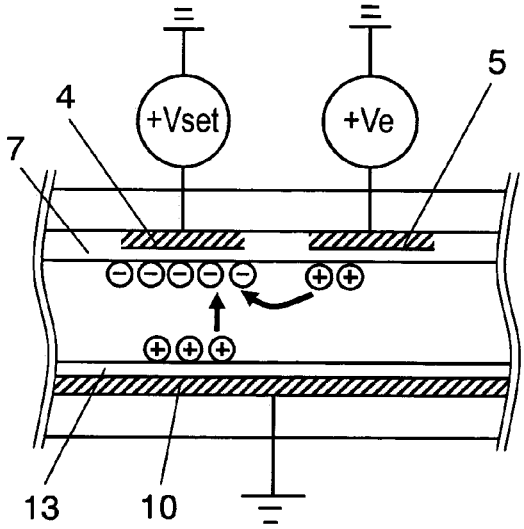
FIG. 4A is a diagram illustrating how wall charge is in the driving waveforms of the PDP in accordance with the exemplary embodiment, during an initializing period thereof.
Figure 4B:
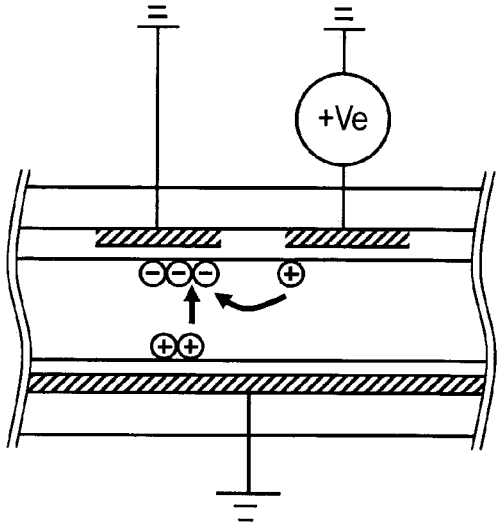
FIG. 4B is a diagram illustrating how wall charge is in the driving waveforms of the PDP in accordance with the exemplary embodiment, at the completion of the initializing period thereof.

When no $H_2$ is added to the discharge gas, increases in the amount of Si or Al added to MgO raise voltage Vs. This phenomenon is considered to be caused by the following mechanism. The mechanism is described with reference to FIGS. 3 and 4. FIG. 3 is a diagram showing waveforms of a PDP. FIG. 4 is a diagram illustrating how the wall charge is at predetermined timings of the driving waveforms of FIG. 3. In other words, FIG. 4A through 4D show how the discharge cell is charged (wall charge) at timings (a) through (d), respectively, of FIG. 3 during initializing using a gradually-sloping voltage waveform of FIG. 3. In the period from timings (a) to (b), weak discharge caused by the gradually-sloping voltage waveform allows the portion between the electrodes in the discharge cell to accumulate wall charge in the state near the discharge-starting voltage. In other words, as shown in FIG. 4A, at timing (a), application of positive voltage to scan electrode 4 causes negative charge to accumulate on dielectric layer 7 on the side of scan electrode 4. In contrast, relatively positive charge accumulates on dielectric layer 7 on the other electrode and on phosphor layer 13. As shown in FIG. 4B, at timing (b), weakened external voltage supply adjusts the wall charge having accumulated at timing (a) to a state where the wall charge is neutralized to some degree with the electric field strength applied between the electrodes kept to the state near the discharge-starting voltage. Therefore, between the respective electrodes, the electric field corresponding to the discharge-starting voltage is still applied to the discharge space. This state is at the completion of the initializing period.

Figure 4C:
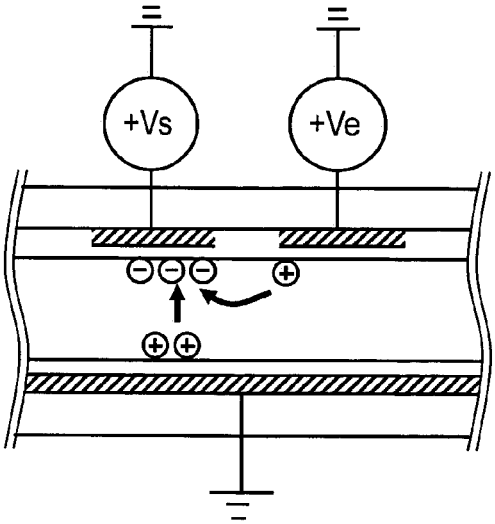
FIG. 4C is a diagram illustrating how wall charge is in the driving waveforms of the PDP in accordance with the exemplary embodiment, at the beginning of an addressing period thereof.
Figure 4D:
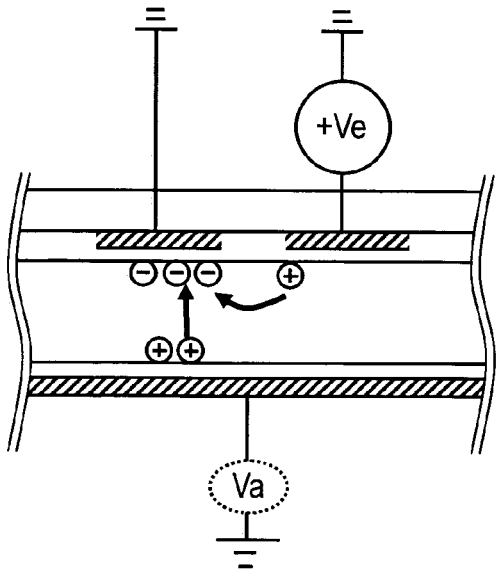
FIG. 4D is a diagram illustrating how wall charge is in the driving waveforms of the PDP in accordance with the exemplary embodiment, during the addressing period thereof.

Next, a description is provided of timings (c) and (d) during an addressing period for selecting discharge cells to be lit during the sustaining period, with reference to FIGS. 4C and 4D, respectively. At timing (c), i.e. a period other than timing (d) in which address discharge is performed on the discharge cells to be lit, voltage Vs, i.e. a scan pulse voltage to keep the wall charge having accumulated during the initializing period stable, is applied to scan electrode 4. In other words, this voltage Vs also works as a voltage having a polarity weakening the electric field generated by the wall charge between the electrodes. Then, during the addressing period, application of voltage Vs is stopped to return the electric field between the electrodes in the discharge cell to the state of timing (b) near the discharge-starting voltage again. Thus, positive voltage exceeding the discharge-starting voltage across the electrodes is applied to address electrode 10 in synchronization with the image, to generate strong discharge and select the cells. At this time, because the initializing driving using a gradually-sloping voltage waveform is performed in the state of the electric filed near the discharge-starting voltage, the voltage to be applied to the address electrode can be made considerably smaller than that of a conventional initializing waveform using a pulse waveform. When this address discharge for selecting discharge cells is performed by sequentially scanning all the scan electrodes 4, the discharge cells can be selected for all the pixels over the entire surface of the PDP formed of a matrix of electrodes.

The wall charge formed particularly during the initializing period must be held in the driving method using the wall charge formed by a gradually-sloping voltage waveform. However, keeping the wall charge stable and increasing electron emission characteristics are conflicting properties. In other words, protective layer 8 of MgO with increased electron emission characteristics is likely to emit accumulated electrons into the discharge space, and thus keeping wall charge stable is difficult. For this reason, high voltage Vs is necessary to keep the wall charge formed on dielectric layer 7 in scan electrode 4 stable.

Now, as shown in each of PDP Nos. 12 through 14 in Table 1, addition of Si or Al in a concentration of at least 30 ppm has made the stability of address discharge more excellent than the case of each of PDP Nos. 1 and 15 with no additives. This is considered because addition of Si or Al in a large amount forms a shallow impurity order in MgO working as a supply source of electrons, and improves the electron emission characteristics. However, as shown in each of PDP Nos. 3, 4, and 6 through 13 of Table 1, addition of at least 30 ppm of Si or Al to MgO and addition of at least 30 ppm of $H_2$ to the discharge gas can increase the electron emission characteristics and keep the wall charge stable at the same time. One of the factors considered is that the discharge-starting voltage in the discharge cell decreased by addition of $H_2$ has inhibited the neutralization of the wall charge so that the force attracting the positive and negative wall charge decreases at the timing (b) of FIG. 3, i.e. in the state of FIG. 4B.

The effect of stabilizing address discharge appears when a concentration of Si added to MgO exceeds 30 ppm, and the effect is particularly prominent at a concentration of 100 ppm or larger. However, in a concentration of 50,000 ppm or larger, deterioration of MgO crystallinity destabilizes address discharge. On the other hand, the effect of Al appears at a concentration of at least 30 ppm, and similarly deterioration of crystallinity at a concentration of at least 50,000 ppm destabilizes address discharge. The similar effect is obtained when the total concentration of Si and Al ranges from 100 to 5,000 ppm inclusive.

Further, $H_2$ to be added has the effect of decreasing voltage Vs in a concentration ranging from 30 to 10,000 ppm. Preferably, the effect is prominent in a concentration ranging from 50 to 1,000 ppm.

Table 1 shows examples having Xe concentrations ranging from 5 to 50%. Increases in the Xe concentration in the discharge gas considerably increase the sustain pulse voltage during the sustaining period of FIG. 3. Increases in the scan voltage during the addressing period can be inhibited even in a Xe concentration of 50% as shown in Table 1. However, because increases in sustaining pulse voltage are large in that concentration, realistically, it is preferable that the Xe concentration ranges from 5 to 30%.

As described above, addition of 30 to 50,000 ppm of Si or Al to a MgO protective layer and 30 to 10,000 ppm of $H_2$ to a discharge gas can provide a PDP capable of stabilizing address discharge and reducing the scan pulse voltage necessary to keep wall charge at the same time, and improving sputtering resistance of the protective layer.

In the above description, a PDP of the so-called surface-discharge type is used. However, the present invention is also applicable to PDPs of the opposite-discharge structure or tube-array structure (T. Shinoda el al., "New approach for wall display with fine tube array technology", SID Symposium 2002) in the similar manner. The present invention is much more effective means to reduce the power of a large PDP larger than 60 in. in diagonal.

INDUSTRIAL APPLICABILITY

The present invention provides a PDP that can give stable address discharge and high brightness and be driven at a low voltage. Thus, the PDP is useful for high-quality plasma display devices.

The invention claimed is:

1. A plasma display panel comprising:

a front panel including an electrode and a dielectric layer;

a rear panel facing the front panel such that a discharge space is formed between the front panel and the rear panel;

a discharge gas filling the discharge space; and a protective layer provided on the dielectric layer, the protective layer being comprised of magnesium oxide and at least one of silicon and aluminum, wherein the discharge gas includes xenon and hydrogen, wherein a concentration of the xenon is at least 5% of the discharge gas and not more than 30% of the discharge gas, and wherein a concentration of the hydrogen in the discharge gas is at least 50 ppm and not more than 1,000 ppm.

2. The plasma display panel of claim 1, wherein a concentration of said at least one of silicon and aluminum in the protective layer is at least 30 ppm and not more than 50,000 ppm.

3. The plasma display panel of claim 1, wherein a concentration of said at least one of the silicon and the aluminum in the protective layer is at least 100 ppm and not more than 50,000 ppm.

4. The plasma display panel of claim 1, wherein the protective layer comprises aluminum.

5. The plasma display panel of claim 1, wherein the protective layer comprises aluminum, and wherein a concentration of aluminum in the protective layer is at least 30 ppm and not more than 50,000 ppm.

6. The plasma display panel of claim 1, wherein the protective layer comprises aluminum, and wherein a concentration aluminum in the protective layer is at least 100 ppm and not more than 50,000 ppm.

7. The plasma display panel of claim 1, wherein the protective layer comprises silicon.

8. The plasma display panel of claim 1, wherein the protective layer comprises silicon, and wherein a concentration of silicon in the protective layer is at least 30 ppm and not more than 50,000 ppm.

9. The plasma display panel of claim 1, wherein the protective layer comprises silicon, and wherein a concentration of silicon in the protective layer is at least 100 ppm and not more than 50,000 ppm.

10. The plasma display panel of claim 1, wherein the discharge gas includes neon.

11. The plasma display panel of claim 1, wherein the discharge gas consists essentially of neon, xenon, and hydrogen.

12. The plasma display panel of claim 1, wherein said at least one of silicon and aluminum is silicon, wherein the concentration of the hydrogen in the discharge gas is about 500 ppm, and wherein the concentration of the xenon is about 15% of the discharge gas.

13. The plasma display panel of claim 1, wherein said at least one of silicon and aluminum is aluminum, wherein the concentration of the hydrogen in the discharge gas is about 30 ppm, and wherein the concentration of the xenon is about 30% of the discharge gas.

14. The plasma display panel of claim 1, wherein said at least one of silicon and aluminum is silicon, wherein the concentration of aluminum in the protective layer is 30,000 ppm, wherein the concentration of the hydrogen in the discharge gas is 500 ppm, and wherein the concentration of the xenon is 15% of the discharge gas.

15. The plasma display panel of claim 1, wherein said at least one of silicon and aluminum is aluminum, wherein the concentration of aluminum in the protective layer is 30,000 ppm, wherein the concentration of the hydrogen in the discharge gas is 30 ppm, and wherein the concentration of the xenon is 30% of the discharge gas.

16. A plasma display panel comprising:

a front panel including an electrode and a dielectric layer;

a rear panel facing the front panel such that a discharge space is formed between the front panel and the rear panel;

a discharge gas filling the discharge space; and a protective layer provided on the dielectric layer, the protective layer being comprised of magnesium oxide and at least one of silicon and aluminum, wherein the discharge gas includes xenon and hydrogen, wherein a concentration of the xenon is at least 5% of the discharge gas and not more than 30% of the discharge gas, wherein a concentration of the hydrogen in the discharge gas is at least 50 ppm and not more than 1,000 ppm, and wherein a concentration of said at least one of silicon and aluminum in the protective layer is about 30,000 ppm.

17. A plasma display panel comprising:

a front panel including an electrode and a dielectric layer;

a rear panel facing the front panel such that a discharge space is formed between the front panel and the rear panel;

a discharge gas filling the discharge space; and a protective layer provided on the dielectric layer, the protective layer being comprised of magnesium oxide and aluminum, wherein the discharge gas includes xenon, hydrogen, and neon, wherein a concentration of the xenon is 30% of the discharge gas, wherein a concentration of the hydrogen in the discharge gas is 30 ppm, wherein a concentration of the aluminum in the protective layer is 30,000 ppm.

* * * * *